US011673758B2

(12) United States Patent
Nagai et al.

(10) Patent No.: US 11,673,758 B2
(45) Date of Patent: Jun. 13, 2023

(54) MEDIUM CONVEYING APPARATUS INCLUDING TRAY PULLED OUT BY SLIDING TWO PROTRUSION BETWEEN RAILS

(71) Applicant: PFU LIMITED, Kahoku (JP)

(72) Inventors: Ryuichi Nagai, Kahoku (JP); Takayuki Umi, Kahoku (JP)

(73) Assignee: PFU LIMITED, Kahoku (JP)

( * ) Notice: Subject to any disclaimer, the term of this patent is extended or adjusted under 35 U.S.C. 154(b) by 0 days.

(21) Appl. No.: 17/450,422

(22) Filed: Oct. 8, 2021

(65) Prior Publication Data

US 2022/0169471 A1 Jun. 2, 2022

(30) Foreign Application Priority Data

Nov. 30, 2020 (JP) ..... JP2020-198674

(51) Int. Cl.
*B65H 31/02* (2006.01)
*G03G 15/00* (2006.01)

(52) U.S. Cl.
CPC ..... *B65H 31/02* (2013.01); *G03G 15/6552* (2013.01); *B65H 2402/32* (2013.01); *B65H 2402/46* (2013.01); *B65H 2405/324* (2013.01); *B65H 2801/12* (2013.01)

(58) Field of Classification Search
CPC ..... B65H 31/02; B65H 2402/32; B65H 2402/46; B65H 2405/324; B65H 2405/1114; B65H 2801/12; G03G 15/6552
See application file for complete search history.

(56) References Cited

U.S. PATENT DOCUMENTS 8,348,263 B2 * 1/2013 Otani ..... G03G 15/6538 271/213
2018/0354739 A1 12/2018 Shimmachi et al.
2020/0252512 A1 * 8/2020 Harada ..... B65H 29/12

FOREIGN PATENT DOCUMENTS

JP 08295447 A * 11/1996
JP 2018-203524 A 12/2018

* cited by examiner

*Primary Examiner* — Yaovi M Ameh
*Assistant Examiner* — Quang X Nguyen
(74) *Attorney, Agent, or Firm* — Lewis Roca Rothgerber Christie LLP

(57) ABSTRACT

A medium conveying apparatus includes a housing including an accommodation portion provided with a guide portion at an end portion in a width direction, a tray accommodated in the accommodation portion so as to be pulled out, and including a placing surface for placing an ejected medium, and an engaging portion provided on a side surface of the tray, to engage the guide portion. The guide portion includes a pair of rails inclined upward and having a predetermined width. The engaging portion includes two protrusions provided so as to slide between the pair of rails and located apart from each other by a predetermined distance. By locating the two protrusions between the pair of rails, the tray is positioned at a predetermined position with respect to the housing with a front end portion of a downstream side in the medium ejecting direction located upward.

6 Claims, 14 Drawing Sheets

MEDIUM CONVEYING APPARATUS INCLUDING TRAY PULLED OUT BY SLIDING TWO PROTRUSION BETWEEN RAILS

CROSS-REFERENCE TO RELATED APPLICATIONS

This application is based upon and claims the benefit of priority of prior Japanese Patent Application No. 2020-198674, filed on Nov. 30, 2020, the entire contents of which are incorporated herein by reference.

TECHNICAL FIELD

Embodiments discussed in the present specification relate to medium conveyance.

BACKGROUND

Recently, a medium conveying apparatus, such as a scanner, conveying a medium to image the medium, and ejecting, is desired to downsize its device size when not in use. Therefore, for example, a medium conveying apparatus of tray accommodation type in which a tray to place the ejected medium is provided so as to be pulled out from an accommodation portion of a body, and the tray is accommodated in the accommodation portion when not in use, is utilized.

A sheet loading apparatus including a first tray and a second tray to increase an inclination angle by tilting up the first tray in conjunction with a drawing of the second tray, is disclosed (see Japanese Unexamined Patent Application Publication (Kokai) No. 2018-203524).

SUMMARY

According to some embodiments, a medium conveying apparatus includes a housing including an accommodation portion provided with a guide portion at an end portion in a width direction perpendicular to a medium ejecting direction, a tray accommodated in the accommodation portion so as to be pulled out, and including a placing surface for placing an ejected medium, and an engaging portion provided on a side surface of the tray, to engage the guide portion. The guide portion includes a pair of rails inclined upward and having a predetermined width. The engaging portion includes two protrusions provided so as to slide between the pair of rails and located apart from each other by a predetermined distance. By locating the two protrusions between the pair of rails, the tray is positioned at a predetermined position with respect to the housing with a front end portion of a downstream side in the medium ejecting direction located upward.

DESCRIPTION OF EMBODIMENTS

It is to be understood that both the foregoing general description and the following detailed description are exemplary and explanatory, and are not restrictive of the invention, as claimed.

Hereinafter, a medium conveying apparatus according to an embodiment, will be described with reference to the drawings. However, it should be noted that the technical scope of the invention is not limited to these embodiments, and extends to the inventions described in the claims and their equivalents.

Figure 1:
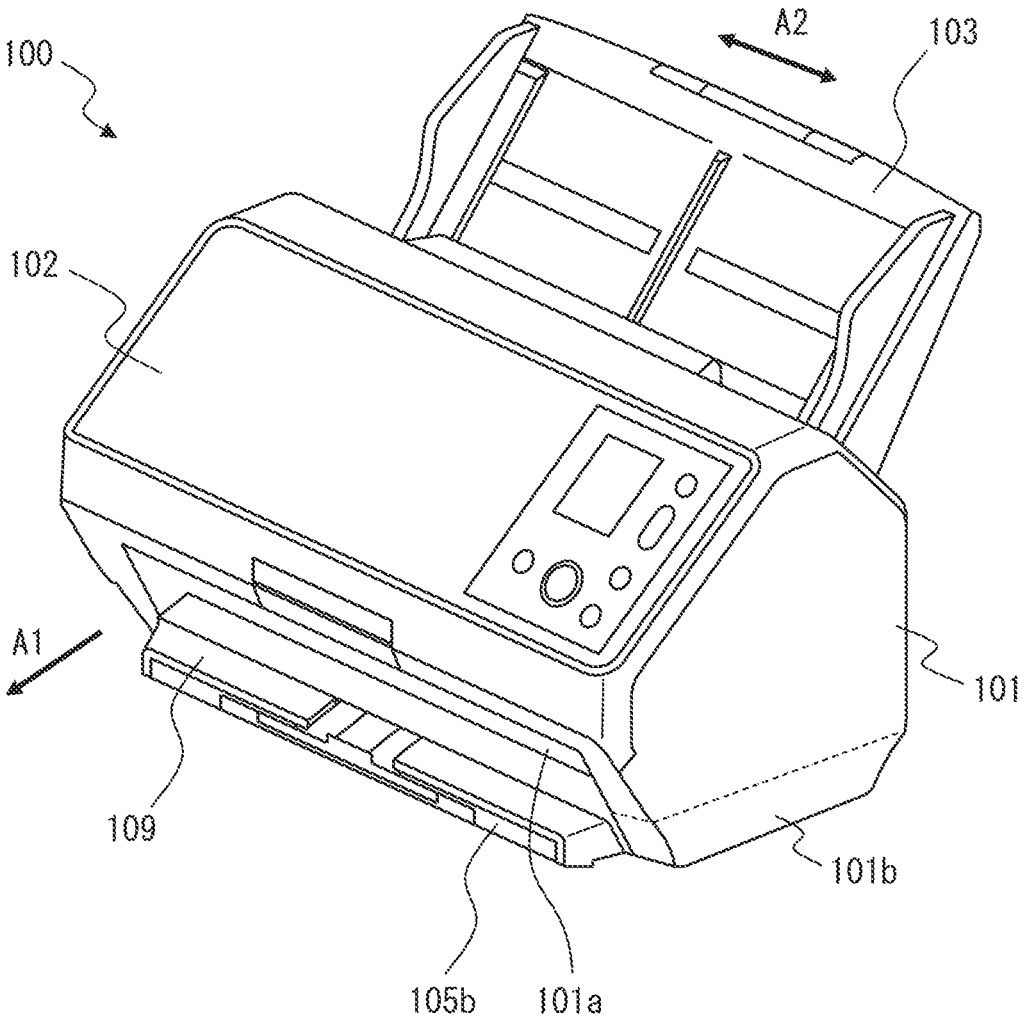
FIG. 1 is a perspective view illustrating a medium conveying apparatus 100 according to an embodiment.
Figure 2:
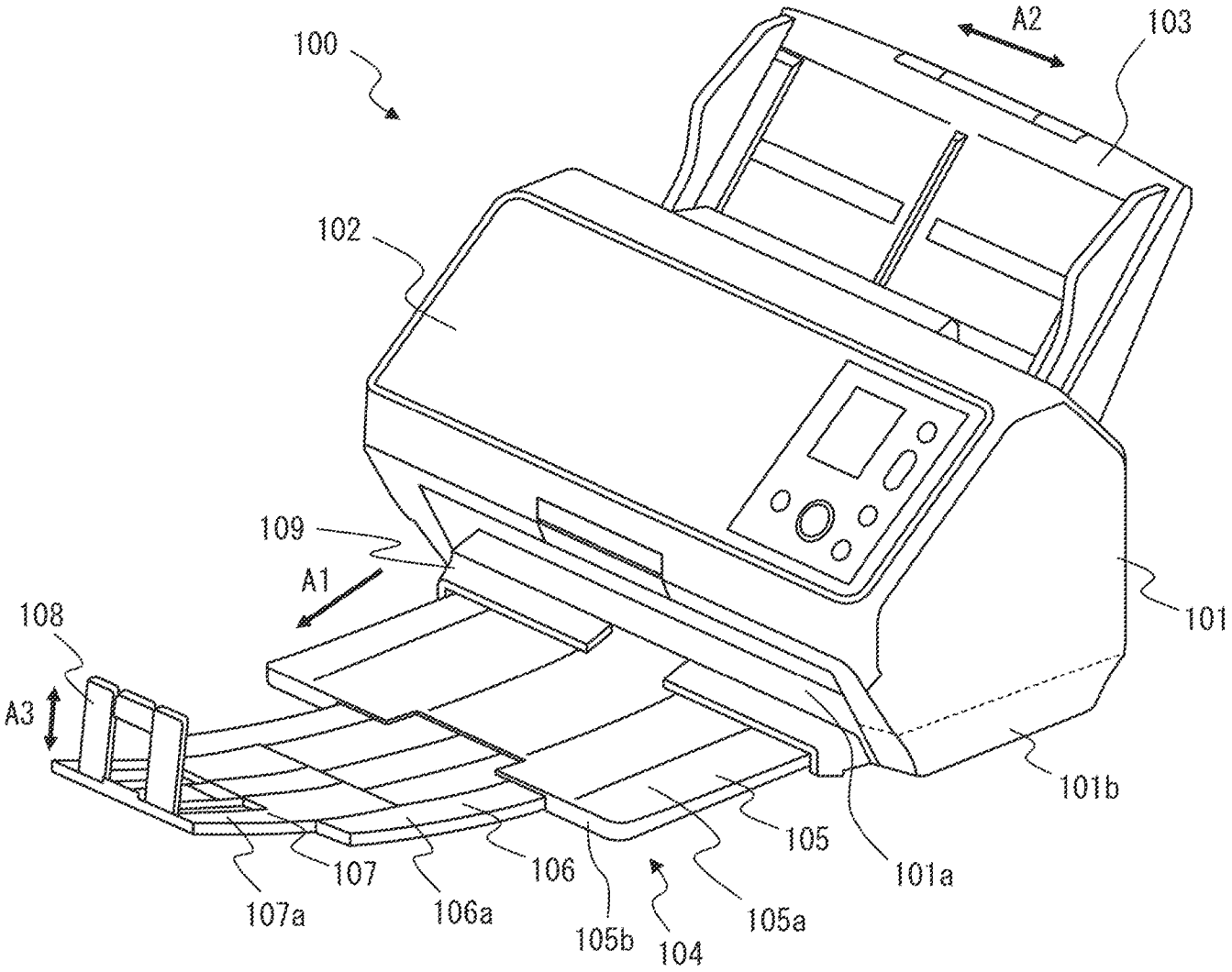
FIG. 2 is a perspective view illustrating the medium conveying apparatus 100 according to the embodiment.

FIGS. 1 and 2 are perspective views illustrating a medium conveying apparatus 100 configured as an image scanner. FIG. 1 illustrates the medium conveying apparatus 100 in a state where an ejection tray 104 is accommodated. FIG. 2 illustrates the medium conveying apparatus 100 in a state where the ejection tray 104 is set.

The medium conveying apparatus 100 conveys, images, and ejects the medium being a document. A medium is a paper, a thick paper, a card, a brochure, a passport, etc. The medium conveying apparatus 100 may be a fax machine, a copying machine, a multifunctional peripheral (MFP), etc. A conveyed medium may not be a document but may be an object being printed on etc., and the medium conveying apparatus 100 may be a printer etc.

The medium conveying apparatus 100 includes a lower housing 101, an upper housing 102, a medium tray 103, and an ejection tray 104, etc. An arrow A1 in FIGS. 1 and 2 indicates a medium ejecting direction. Hereinafter, an upstream refers to an upstream in the medium ejecting direction A1, and a downstream refers to a downstream in the medium ejecting direction A1. An arrow A2 indicates a width direction perpendicular to the medium ejecting direction A1. An arrow A3 indicates a height direction perpendicular to an upper surface of the ejection tray 104.

The lower housing 101 and the upper housing 102 are an example of a housing. The upper housing 102 is located in a position covering a top surface of the medium conveying apparatus 100, and is engaged with the lower housing 101 by a hinge. The lower housing 101 and the upper housing 102 include an ejection port 101*a* to eject the medium. The lower housing 101 is an example of a housing, and includes an accommodation portion 101*b* to accommodate the ejection tray 104.

The medium tray 103 is engaged with the lower housing 101 in such a way as to be able to place a medium to be conveyed.

The ejection tray 104 is provided below the ejection port 101*a*, and is attached to the lower housing 101 so as to place the medium ejected from the ejection port 101*a*. The ejection tray 104 is formed of a resin member or a metal member, etc. The ejection tray 104 is accommodated in the accommodation portion 101*b* of the lower housing 101 when the medium conveying apparatus 100 is not used, and the ejection tray 104 is drawn from the lower housing 101 in the medium ejecting direction A1, to place the medium ejected from the ejection port 101*a* when the medium conveying apparatus 100 is used. The ejection tray 104 includes a first ejection tray 105, a second ejection tray 106, a third ejection tray 107, a stopper 108 and a cover 109.

The first ejection tray 105 is an example of a tray, is accommodated in the accommodation portion 101*b* of the lower housing 101 so as to be pulled out, and includes a placing surface 105*a* for placing the ejected medium. The first ejection tray 105 is provided so as to be pulled out from the accommodation portion 101*b* in the medium ejecting direction A1. The first ejection tray 105 is accommodated in the accommodation portion 101*b* when not in use, and the first ejection tray 105 is pulled out from the accommodation portion 101*b* to place the ejected medium when used.

The second ejection tray 106 is accommodated in the first ejection tray 105 so as to be pulled out, and has a placing surface 106*a* for placing the ejected medium. The second ejection tray 106 is provided so as to be pulled out from the first ejection tray 105 in the medium ejecting direction A1. The second ejection tray 106 is accommodated in the first ejection tray 105 when not in use, and the second ejection tray 106 is pulled out from the first ejection tray 105, to place the ejected medium, particularly large size media when used.

The third ejection tray 107 is accommodated in the second ejection tray 106 so as to be pulled out, and includes a placing surface 107*a* for placing the ejected medium. The third ejection tray 107 is provided so as to be pulled out from the second ejection tray 106 in the medium ejecting direction A1. The third ejection tray 107 is accommodated in the second ejection tray 106 when not in use, and the third ejection tray 107 is pulled out from the second ejection tray 106, to place the ejected medium, particularly larger size media when used.

The stopper 108 is provided foldably with respect to the third ejection tray 107, to stop a front end of the ejected medium, and regulate the front end of each medium, in a standing state.

The cover 109 is a cover for covering the first ejection tray 105, the second ejection tray 106, the third ejection tray 107 and the stopper 108 accommodated in the lower housing 101. The cover 109 covers the accommodation portion 101*b* along with a front end portion 105*b* of the downstream side of the medium ejecting direction A1 of the first ejection tray 105, and prevent dust, etc., from entering the accommodation portion 101*b*.

Figure 3:
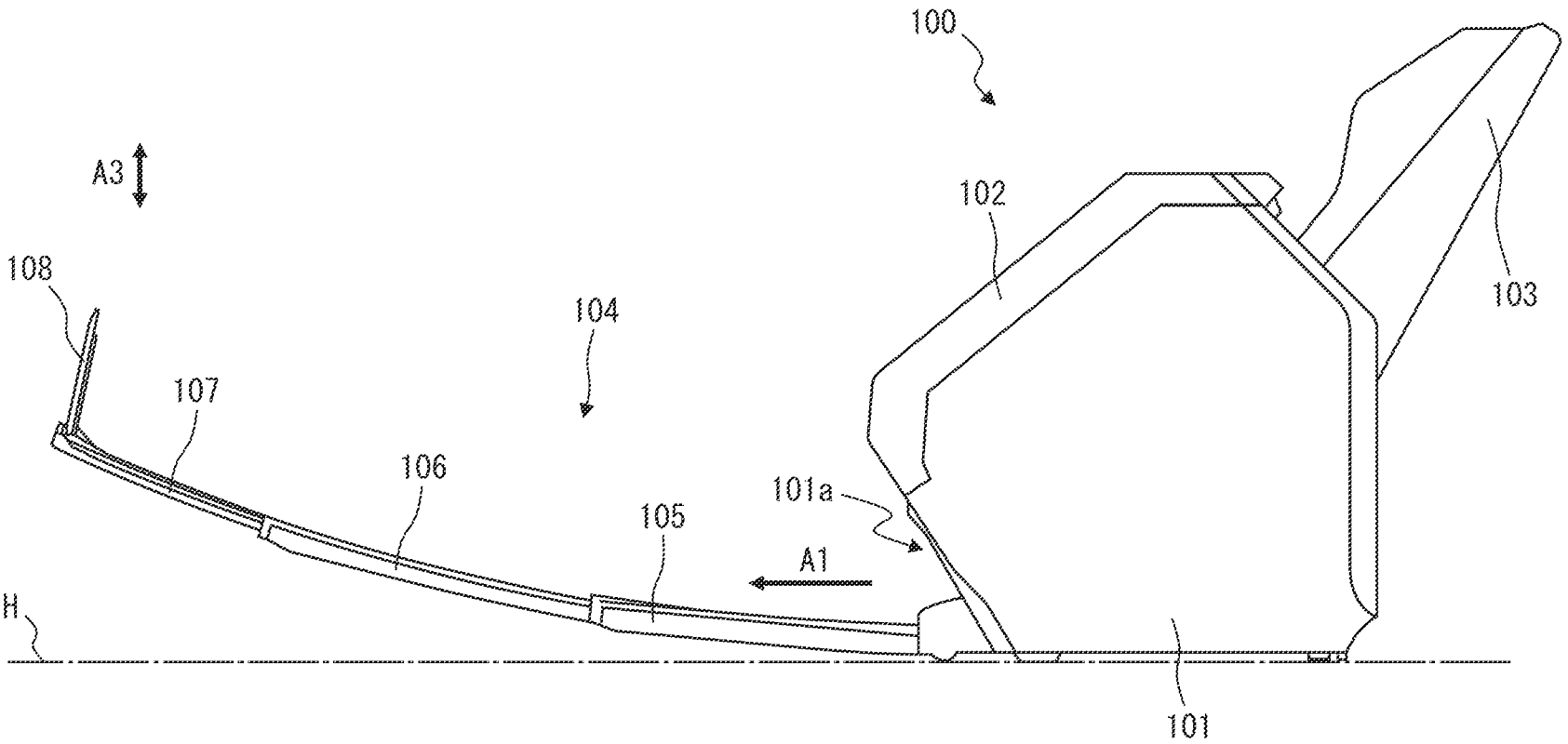
FIG. 3 is a side view of the medium conveying apparatus 100, as viewed from the side.

FIG. 3 is a side view of the medium conveying apparatus 100, as viewed from the side.

As illustrated in FIG. 3, the ejection tray 104 is located inclined with respect to an installation surface H where the medium conveying apparatus 100 is installed, such that the front end portion of the downstream side of the medium ejecting direction A1 is positioned upward. The first ejection tray 105, the second ejection tray 106 and the third ejection tray 107 are formed in a substantially planar shape (substantially linear when viewed from the side). The first ejection tray 105, the second ejection tray 106 and the third ejection tray 107 are located such that the inclination with respect to the installation surface H is gradually increase, in the order of the first ejection tray 105, the second ejection tray 106 and the third ejection tray 107.

Figure 4:
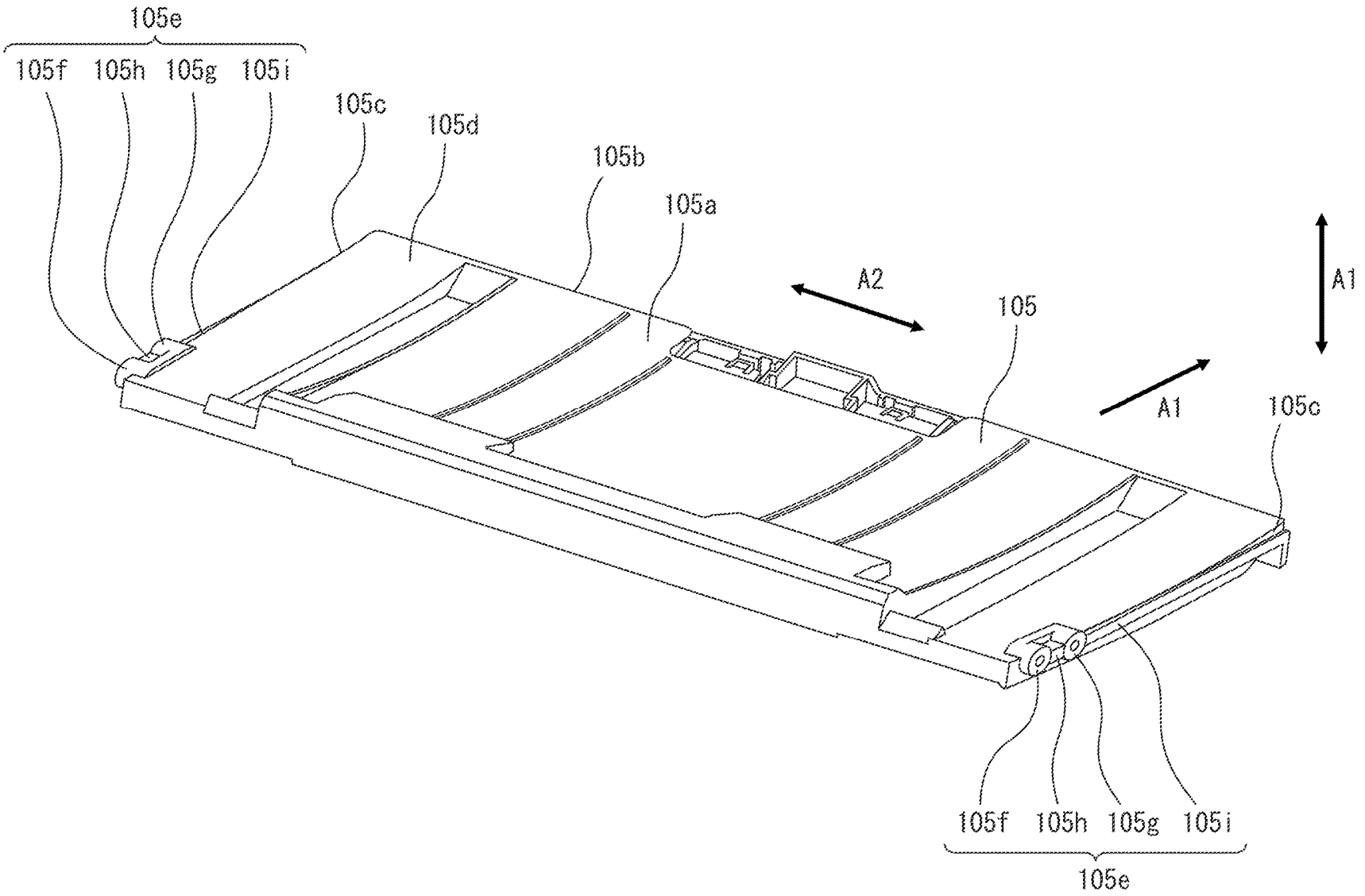
FIG. 4 is a schematic diagram for illustrating a first ejection tray 105.

FIG. 4 is a schematic diagram for illustrating the first ejection tray 105. FIG. 4 illustrates the first ejection tray 105 in a state where the first ejection tray 105 is removed from the lower housing 101, and the second ejection tray 106, the third ejection tray 107 and the stopper 108 are accommodated.

As illustrated in FIG. 4, the first ejection tray 105 includes a placing portion 105*d* and two engaging portions 105*e*. The placing portion 105*d* includes a placing surface 105*a*, to place the ejected medium on the placing surface 105*a*. The two engaging portions 105*e* are provided on two side surfaces 105*c* of the first ejection tray 105, i.e., on both ends in the width direction A2 perpendicular to the medium ejecting direction. The number of the engaging portion 105*e* may be one. In this case, the engaging portion 105*e* is provided only on one side surface 105*c* of the first ejection tray 105. Each engaging portion 105*e* includes a first protrusion 105*f*, a second protrusion 105*g*, a bond portion 105*h* and an auxiliary supporting portion 105*i*, etc.

The first protrusion 105*f* and the second protrusion 105*g* are located apart from each other by a predetermined distance in the medium ejecting direction A1. The first protrusion 105*f* and the second protrusion 105*g* protrude upward from the placing surface 105*a* of the first ejection tray 105 in the height direction A3, respectively. The first protrusion 105*f* and the second protrusion 105*g* may project downward from the lower surface of the first ejection tray 105 in the height direction A3. The first protrusion 105*f* and the second protrusion 105*g* project outward from the placing surface 105*a* in the width direction A2.

The first protrusion 105*f* and the second protrusion 105*g* have an oval shape. In particular, the first protrusion 105*f* and the second protrusion 105*g* have a shape of two parallel sides extending in the medium ejecting direction A1 and two semicircles. The first protrusion 105*f* and the second protrusion 105*g* may have any other shape having a curved line, such as a circular shape, an elliptical shape, an egg shape, or a rounded rectangular shape. A rounded rectangle is a rectangle with rounded corners. The first protrusion 105*f*, the second protrusion 105*g* and the bond portion 105*h* may have a gourd-like shape as a whole.

The bond portion 105*h* is provided to bond the first protrusion 105*f* and the second protrusion 105*g*. The bond portion 105*h* protrudes outward from the placing surface 105*a*, and is formed so as to be flush with the first protrusion 105*f* and the second protrusion 105*g*, in the width direction A2. On the other hand, the bond portion 105*h* does not protrude upward from the placing surface 105*a* of the first ejection tray 105, and does not protrude downward from the lower surface of the first ejection tray 105, in the height direction A3. That is, the first protrusion 105*f* and the second protrusion 105*g* protrude upward and/or downward from the bond portion 105*h* in the height direction A3, respectively.

The auxiliary supporting portion 105*i* is located on the upstream side of the first protrusion 105*f*, the bond portion 105*h* and the second protrusion 105*g*. The auxiliary supporting portion 105*i* protrudes outward from the placing surface 105*a*, and is formed so as to be flush with the first protrusion 105*f*, the bond portion 105*h* and the second protrusion 105*g*, in the width direction A2. On the other hand, the auxiliary supporting portion 105*i* does not protrude upward from the placing surface 105*a* of the first ejection tray 105, and does not protrude downward from the lower surface of the first ejection tray 105, in the height direction A3. That is, the first protrusion 105*f* and the second protrusion 105*g* protrude upward and/or downward from the auxiliary supporting portion 105*i* in the height direction A3, respectively.

Figure 5A:
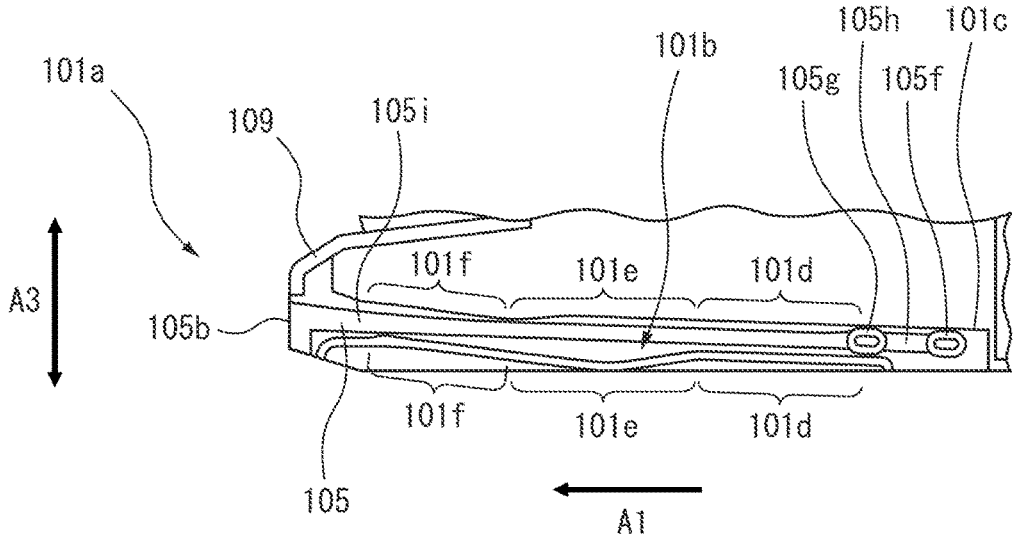
FIG. 5A is a schematic view for illustrating the first ejection tray 105, etc.
Figure 5B:
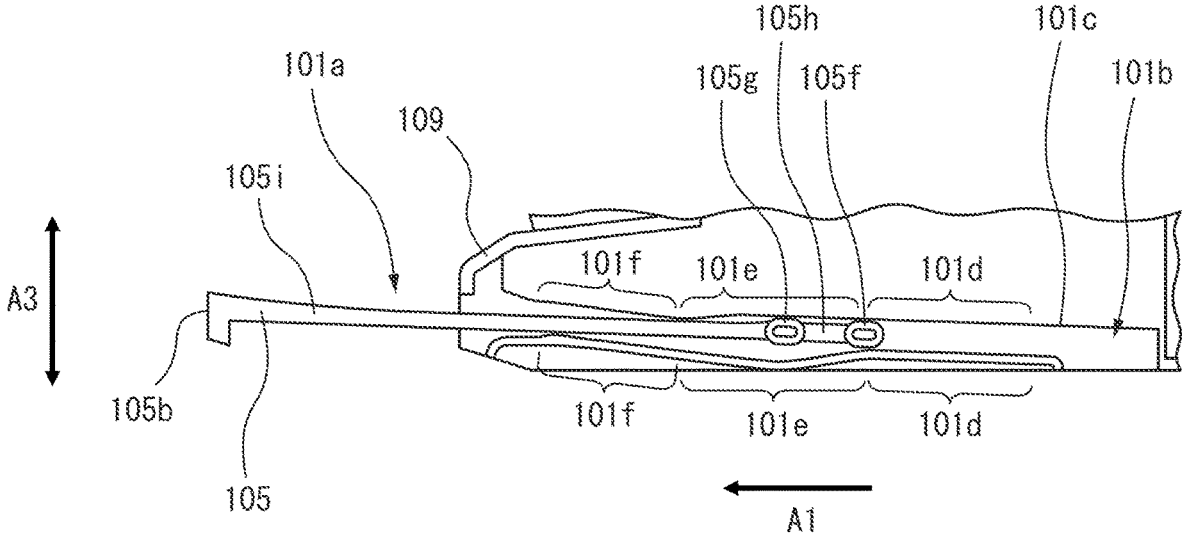
FIG. 5B is a schematic view for illustrating the first ejection tray 105, etc.
Figure 6A:
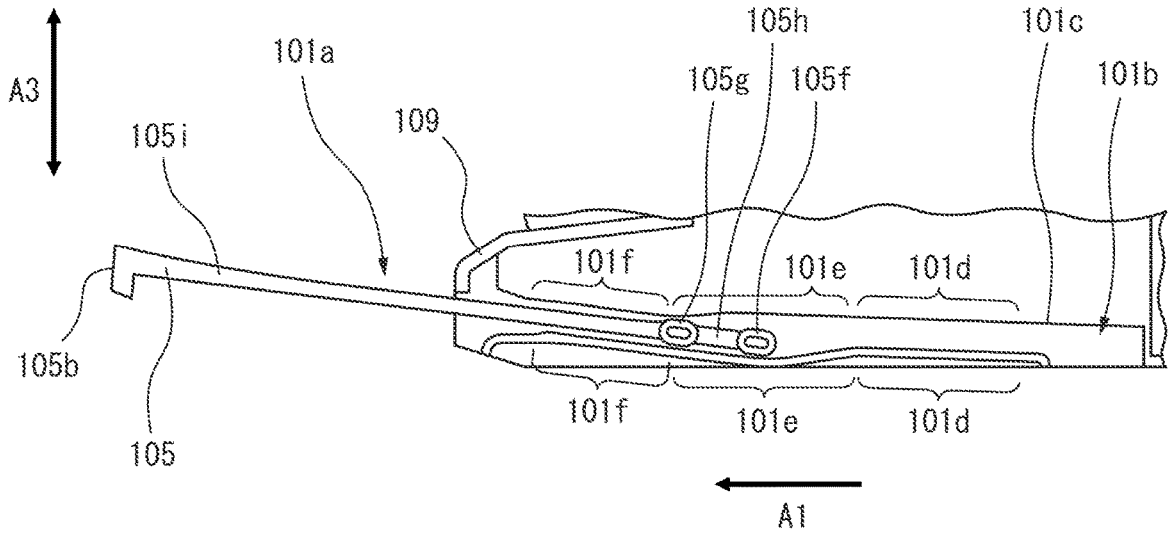
FIG. 6A is a schematic view for illustrating the first ejection tray 105, etc.
Figure 6B:
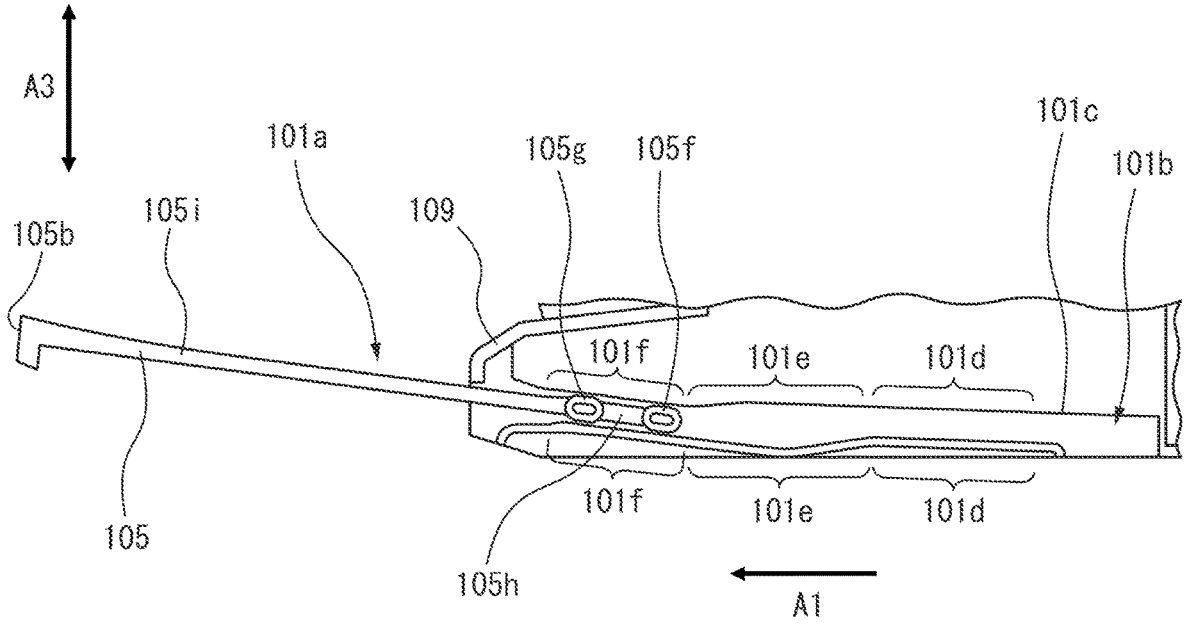
FIG. 6B is a schematic view for illustrating the first ejection tray 105, etc.

FIGS. 5A, 5B, 6A and 6B are schematic diagrams for illustrating the first ejection tray 105 and the accommodation portion 101*b*. FIGS. 5A, 5B, 6A and 6B are cross-sectional views of the accommodation portion 101*b* cut in a cross section parallel to the medium ejecting direction A1 and the height direction A3. FIG. 5A is a cross-sectional view of the accommodation portion 101*b* in which the first ejection tray 105 is accommodated. FIG. 5B is a cross-sectional view of the accommodation portion 101*b* in which the first ejection tray 105 is slightly pulled out. FIG. 6A is a cross-sectional view of the accommodation portion 101*b* in which the first ejection tray 105 is further pulled out from a state shown in FIG. 5B. FIG. 6B is a cross-sectional view of the accommodation portion 101*b* in which the first ejection tray 105 is fully pulled out.

As illustrated in FIGS. 5A, 5B, 6A and 6B, the accommodation portion 101*b* is provided with a guide portion 101*c* at an end portion in the width direction A2 perpendicular to the medium ejecting direction, in particular, inside a side surface provided at both end portions in the width direction A2 perpendicular to the medium ejecting direction. The guide portion 101*c* is located so as to face the engaging portion 105*e* provided on the side surface 105*c* of the first ejection tray 105. When the number of the engaging portion 105*e* provided in the first ejection tray 105 is one, the guide portion 101*c* is provided only on the side surface facing the one engaging portion 105*e*. The guide portion 101*c* includes a pair of first rails 101*d*, a pair of second rails 101*e* and a pair of third rails 101*f*.

The pair of first rails 101*d* are provided at an upstream end portion of the guide portion 101*c* in the medium ejecting direction A1. The pair of first rails 101*d* extend substantially in parallel to the installation surface of the medium conveying apparatus 100 and have a predetermined width. The predetermined width is substantially the same size as a size of the first protrusion 105*f* and the second protrusion 105*g* provided in the first ejection tray 105 in the height direction A3.

The pair of second rails 101*e* is provided on the downstream side of the first rail 101*d* in the medium ejecting direction A1. A lower rail portion of the pair of second rails 101*e* is formed to be recessed downward, and the pair of second rails 101*e* has a width larger than the predetermined width of the pair of first rails 101*d*.

The pair of third rails 101*f* is an example of a pair of rails, and is provided on the downstream side of the second rail 101*e*, in particular, on a downstream end portion of the guide portion 101*c*, in the medium ejecting direction A1. The pair of third rails 101*f* is inclined upward so that the downstream end portion is positioned upward, and has the same width as the predetermined width of the first rail 101*d*.

In this manner, since the first rail 101*d* extends substantially parallel to the installation surface of the medium conveying apparatus 100 and the third rail 101*f* is inclined upward, the guide portion 101*c* is bent upward.

As described above, the widths of the pair of first rails 101*d* and the pair of third rails 101*f* are substantially the same as the sizes of the first protrusion 105*f* and the second protrusion 105*g* of the engaging portion 105*e* in the height direction A3. Therefore, the engaging portion 105*e* engages with the pair of first rails 101*d* and the pair of third rails 101*f* of the guide portion 101*c*. The engaging portion 105*e* is provided so as to slide between the pair of first rails 101*d* and the pair of third rails 101*f*.

Hereinafter, a pulling out operation of the first ejection tray 105 will be described.

As illustrated in FIG. 5A, when the first ejection tray 105 is accommodated in the accommodation portion 101*b*, the second protrusion 105*g* of the engaging portion 105*e* of the first ejection tray 105 is located between the pair of first rails 101*d* and is clamped by the pair of first rails 101*d*. In this case, an upper end of the first protrusion 105*f* provided on the upstream side of the second protrusion 105*g* and a part of an upper surface of the auxiliary support portion 105*i* provided on the downstream side of the second protrusion 105*g* contact an upper surface of the guide portion 101*c*. Thus, the first ejection tray 105 is positioned in a predetermined accommodation position with respect to the lower housing 101.

As illustrated in FIG. 5B, when the first ejection tray 105 is slightly pulled out from the accommodation portion 101*b*, the first protrusion 105*f* and the second protrusion 105*g* slide along the first rail 101*d* extending substantially in parallel to the installation surface of the medium conveying apparatus 100. Thus, the first ejection tray 105 slides in substantially parallel to the installation surface of the medium conveying apparatus 100.

As illustrated in FIG. 6A, when the first ejection tray 105 is further pulled out from the accommodation portion 101*b*, the first protrusion 105*f* located on the upstream side slides along the lower rail part of the second rail 101*e* formed to be recessed downward. Thus, the first ejection tray 105 is inclined such that the front end portion 105*b* of the downstream side in the medium ejecting direction A1 is positioned upward.

As illustrated in FIG. 6B, when the first ejection tray 105 is fully pulled out from the accommodation portion 101*b*, the second protrusion 105*g* and the first protrusion 105*f* are located between the pair of third rails 101*f*, and are clamped by the pair of third rails 101*f* Thus, the first ejection tray 105 is positioned at a predetermined set position with respect to the lower housing 101 with the front end portion 105*b* of the downstream side in the medium ejecting direction A1 located upward.

As described above, the first protrusion 105*f* and the second protrusion 105*g* have a shape of two parallel sides and two semicircles. The first protrusion 105*f* and the second protrusion 105*g* can change an orientation smoothly by a rounded corner, when the first ejection tray 105 is pulled out from the accommodation portion 101*b*, even when the first protrusion 105*f* or the second protrusion 105*g* come into contact with a bent position in the guide portion 101*c*. Further, since the first protrusion 105*f* and the second protrusion 105*g* have two parallel sides, the contact surface between the first protrusion 105*f* and the second protrusion 105*g*, and the rail in the guide portion 101*c* is large.

Therefore, the first protrusion 105*f* and the second protrusion 105*g* are stably clamped by the pair of first rails 101*d* or the pair of third rails 101*f*.

Further, the medium conveying apparatus 100 can increase the strength of the first protrusion 105*f* and the second protrusion 105*g* by the bond portion 105*h* provided between the first protrusion 105*f* and the second protrusion 105*g*. Thus, the first protrusion 105*f* and the second protrusion 105*g* are stably clamped by the pair of first rails 101*d* or the pair of third rails 101*f*, and an occurrence of a breakage of the engaging portion 105*e* is suppressed.

Further, since the first protrusion 105*f* and the second protrusion 105*g* sliding along the guide portion 101*c* are located apart from each other, the recess is provided between the first protrusion 105*f* and the second protrusion 105*g*. Therefore, the first ejection tray 105 can change the orientation with a margin in the accommodation portion 101*b*. In particular, since the medium conveying apparatus 100 is provided with the recess with respect to the upper ends of the first protrusion 105*f* and the second protrusion 105*g*, the first ejection tray 105 can change the orientation upward with a margin in the accommodation portion 101*b*. Since the medium conveying apparatus 100 can increase the degree of freedom of the shapes of the accommodation portion 101*b* and the guide portion 101*c*, the developer can easily design the accommodation portion 101*b* and the guide portion 101*c*, and thereby, reduce the number of man-hours for developing the medium conveying apparatus 100.

The sizes in which the first protrusion 105*f* and the second protrusion 105*g* of the engaging portion 105*e* protrude from the upper surface of the placing surface 105*a* or the bond portion 105*h* are determined based on the shape of the guide portion 101*c* bent upward. When the sizes in which the first protrusion 105*f* and the second protrusion 105*g* protrude are too small, the bond portion 105*h* may collide with the guide portion 101*c* at a position where the guide portion 101*c* bends, and the first ejection tray 105 may not be able to change the orientation. On the other hand, when the sizes in which the first protrusion 105*f* and the second protrusion 105*g* protrude are too large, the size of the guide portion 101*c* needs to be large, and the size of the medium conveying apparatus 100 needs to be large. The sizes in which the first protrusion 105*f* and the second protrusion 105*g* protrude from the upper surface of the placing surface 105*a* or the bond portion 105*h* is determined such that the placing surface 105*a* or the bond portion 105*h* do not come into contact with the guide portion 101*c* when the first ejection tray 105 is pulled out.

A distance between the center positions of the first protrusion 105*f* and the second protrusion 105*g* is determined based on the material (hardness) or the weight of the first ejection tray 105, and/or the arrangement positions of the first protrusion 105*f* and the second protrusion 105*g*. When a distance between the center positions of the first protrusion 105*f* and the second protrusion 105*g* of the engaging portion 105*e* is too large, the bond portion 105*h* may collide with the guide portion 101*c* at the position where the guide portion 101*c* bends, and the first ejection tray 105 may not be able to change the orientation. On the other hand, when the distance between the center positions of the first protrusion 105*f* and the second protrusion 105*g* of the engaging portion 105*e* is too small, the engaging portion 105*e* cannot support the first ejection tray 105, and the engaging portion 105*e* may be damaged. The distance between the center positions of the first protrusion 105*f* and the second protrusion 105*g* is determined to a length such that the engaging portion 105*e* satisfactorily supports the first ejection tray 105.

The engaging portion 105*e* may have at least the first protrusion 105*f* and the second protrusion 105*g*, and the bond portion 105*h* and/or the auxiliary support portion 105*i* may be omitted.

Figure 7:
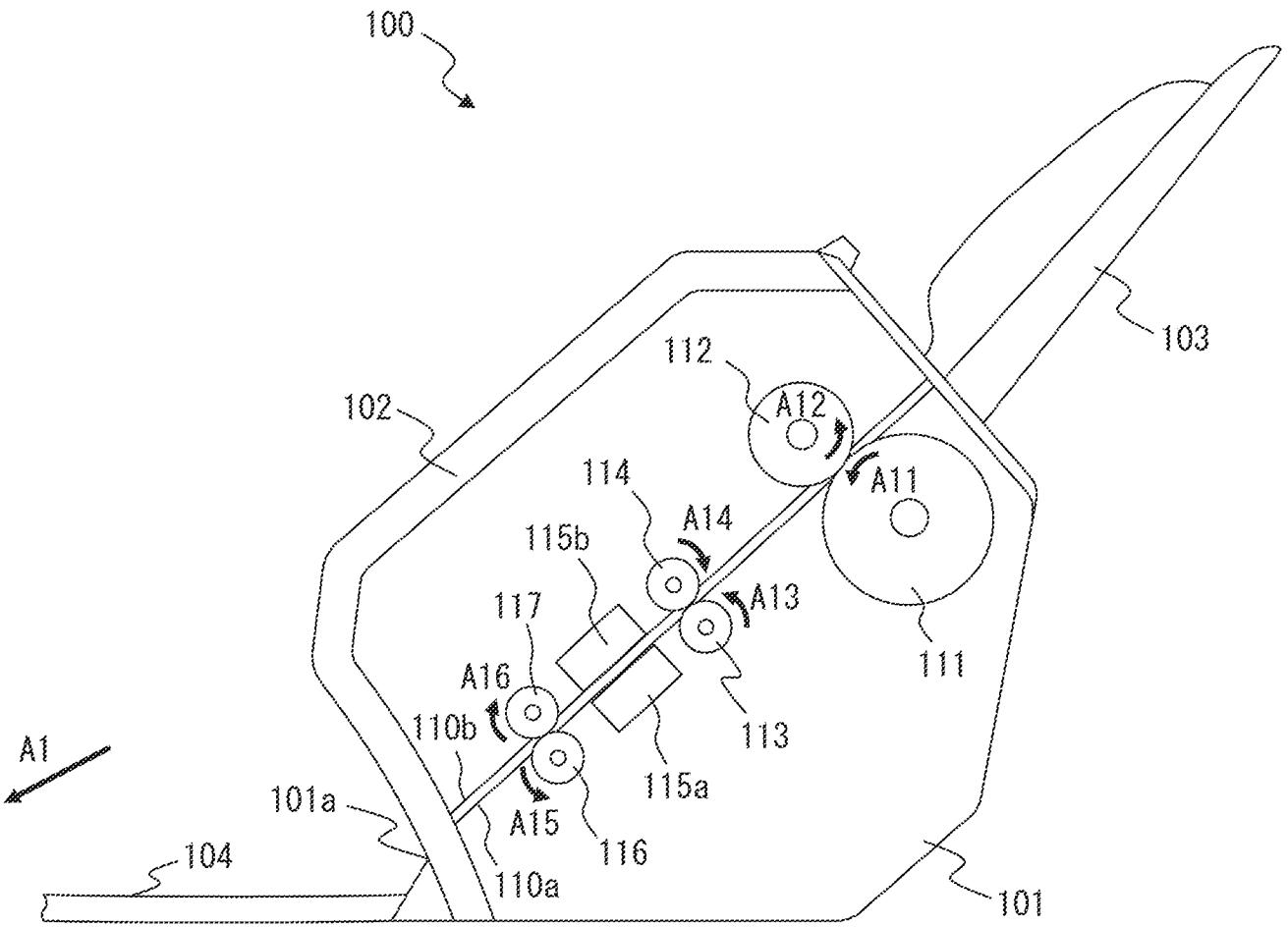
FIG. 7 is a diagram for illustrating a conveyance path inside the medium conveying apparatus 100.

FIG. 7 is a diagram for illustrating a conveyance path inside the medium conveying apparatus 100.

The conveyance path inside the medium conveying apparatus 100 includes the feed roller 111, the brake roller 112, the first conveying roller 113, the second conveying roller 114, the first imaging device 115*a*, the second imaging device 115*b*, the first ejection roller 116 and the second ejection roller 117, etc. The number of each roller is not limited to one, and may be plural. A top surface of the lower housing 101 forms a lower guide 110*a* of a conveyance path of a medium, and a bottom surface of the upper housing 102 forms an upper guide 110*b* of the conveyance path of a medium.

The first imaging device 115*a* includes a line sensor based on a unity-magnification optical system type contact image sensor (CIS) including an imaging element based on a complementary metal oxide semiconductor (CMOS) linearly located in a main scanning direction. Further, the first imaging device 115*a* includes a lens for forming an image on the imaging element, and an analog-digital (A/D) converter for amplifying and analog-digital (A/D) converting an electric signal output from the imaging element. The first imaging device 115*a* generates and outputs an input image imaging a front surface of a conveyed medium, in accordance with control from a processing circuit (not shown).

Similarly, the second imaging device 115*b* includes a line sensor based on a unity-magnification optical system type CIS including an imaging element based on a CMOS linearly located in a main scanning direction. Further, the second imaging device 115*b* includes a lens for forming an image on the imaging element, and an A/D converter for amplifying and A/D converting an electric signal output from the imaging element. The second imaging device 115*b* generates and outputs an input image imaging a back surface of a conveyed medium, in accordance with control from the processing circuit.

Only either of the first imaging device 115*a* and the second imaging device 115*b* may be located in the medium conveying apparatus 100 and only one surface of a medium may be read. Further, a line sensor based on a unity-magnification optical system type CIS including an imaging element based on charge coupled devices (CCDs) may be used in place of the line sensor based on a unity-magnification optical system type CIS including an imaging element based on a CMOS. Further, a line sensor based on a reduction optical system type line sensor including an imaging element based on CMOS or CCDs.

The medium placed on the medium tray 103 is conveyed in the medium ejecting direction A1 between the lower guide 110*a* and the upper guide 110*b* by the feed roller 111 rotating in a direction of an arrow A11 in FIG. 7. When the medium is conveyed, the brake roller 112 rotates in a direction of an arrow A12. By the workings of the feed roller 111 and the brake roller 112, when a plurality of media are placed on the medium tray 103, only a medium in contact with the feed roller 111, out of the media placed on the medium tray 103, is separated. Consequently, conveyance of a medium other than the separated medium is restricted (prevention of multi-feed).

The medium is fed between the first conveyance roller 113 and the second conveyance roller 114 while being guided by the lower guide 110*a* and the upper guide 110*b*. The medium is fed between the first imaging device 115*a* and the second imaging device 115*b* by the first conveyance roller 113 and the second conveyance roller 114 rotating in directions of an arrow A13 and an arrow A14, respectively, and is read by the first imaging device 115*a* and the second imaging device 115*b*. The first ejection roller 116 and the second ejection roller 117 eject the medium on the ejection tray 104 by rotating in directions of arrows A15 and A16, respectively. The ejecting table 104 places the medium ejected by the first ejection roller 116 and the second ejection roller 117.

As described in detail above, in the medium conveying apparatus 100, the first protrusion 105*f* and the second protrusion 105*g* which are slidable between the third rails 101*f* provided in the guiding portion 101*c* are located in the engaging portion 105*e* of the first ejection tray 105 which engages with the guiding portion 101*c* of the lower housing 101. The first protrusion 105*f* and the second protrusion 105*g* are located apart from each other. Therefore, the recess is provided between the first protrusion 105*f* and the second protrusion 105*g* which slide along the third rails 101*f*, and the first ejection tray 105 can change the orientation with a margin in the accommodating portion 101*b* when pulled out from the accommodating portion 101*b*. Therefore, in the medium conveying apparatus 100, the first ejection tray 105 can be pulled out satisfactorily from the accommodation portion 101*b* of the lower housing 101.

Generally, an ejection tray of a medium conveying apparatus has a bent shape, and/or is located to be inclined greatly in order to enhance an alignability of a medium. In order to accommodate such an ejection tray in a housing, the medium conveying apparatus needs to increase a space of an accommodation portion, and thereby, needs to increase the device size of the medium conveying apparatus. The medium conveying apparatus 100 can change the orientation of the ejection tray 104 with a margin in the accommodation portion 101*b* when the ejection tray 104 is pulled out from the accommodation portion 101*b*. Therefore, the medium conveying apparatus 100 can achieve both improving the alignability of the medium, and accommodating the ejection tray 104 in the housing, while suppressing an increase in the device size.

Figure 8:
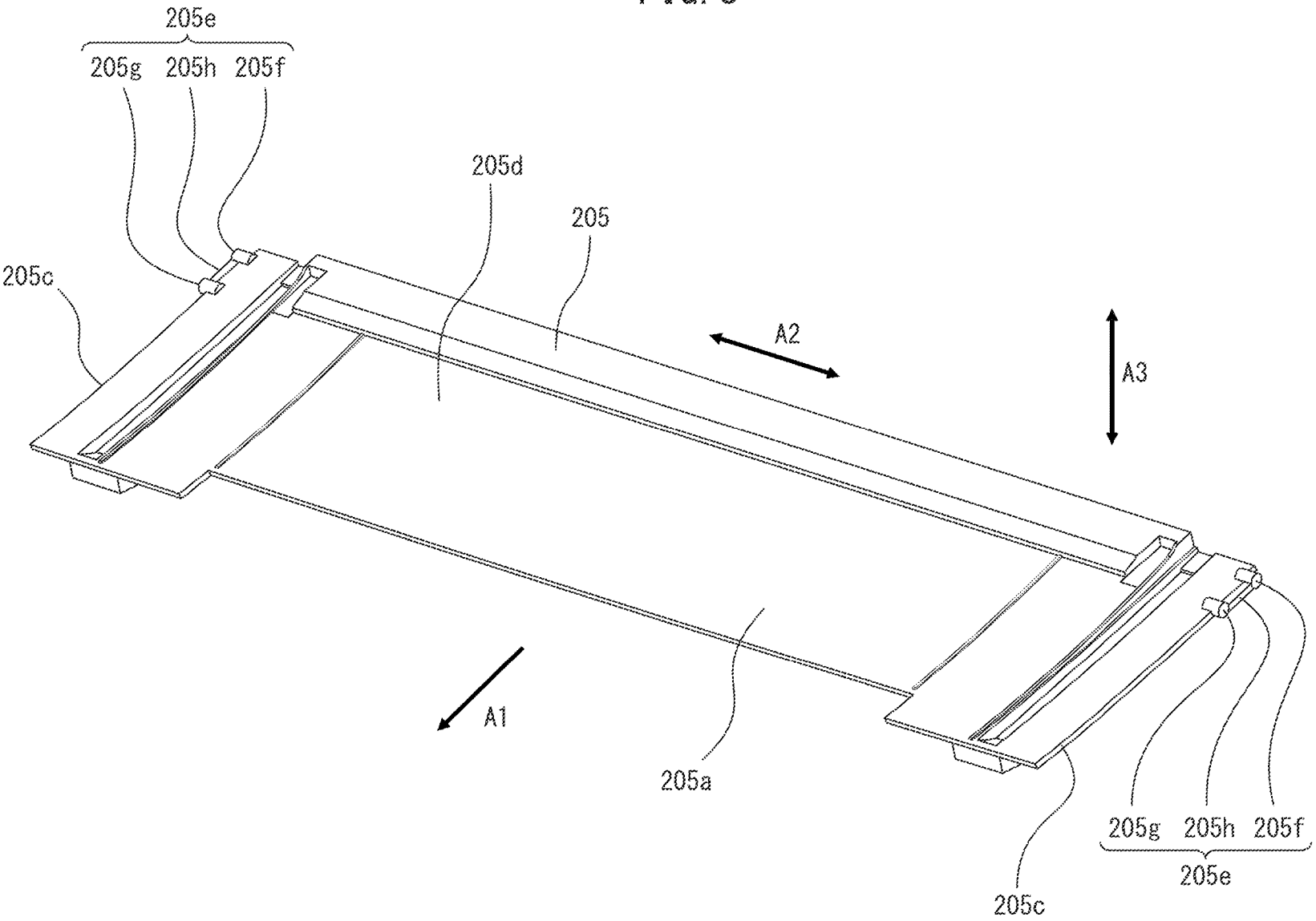
FIG. 8 is a schematic diagram for illustrating another first ejection tray 205.

FIG. 8 is a schematic diagram for illustrating a first ejection tray 205 of the medium conveying apparatus according to another embodiment. FIG. 8 illustrates the first ejection tray 205 in a state where the first ejection tray 205 is removed from the lower housing 101, and a second ejection tray, the third ejection tray and the stopper are removed from the first ejection tray 205.

The first ejection tray 205 is used in place of the first ejection tray 105 of the medium conveying apparatus 100. As illustrated in FIG. 8, the first ejection tray 205 includes a placing portion 205*d* and two engaging portions 205*e*. The placing portion 205*d* includes a placing surface 205*a*, to place the ejected medium on the placing surface 205*a*. The two engaging portions 205*e* are provided on two side surfaces 205*c* of the first ejection tray 205, i.e., at both ends in the width direction A2 perpendicular to the medium ejecting direction. The number of the engaging portion 205*e* may be one. Each engaging portion 205*e* has a first protrusion 205*f*, a second protrusion 205*g* and a bond portion 205*h*, etc.

The first protrusion 205*f* and the second protrusion 205*g* are located apart from each other by a predetermined distance in the medium ejecting direction A1. The first protrusion 205*f* and the second protrusion 205*g* protrude upward from the placing surface 205*a* of the first ejection tray 205 in the height direction A3. The first protrusion 205*f* and the second protrusion 205*g* may protrude downward from the lower surface of the first ejection tray 205 in the height direction A3. The first protrusion 205*f* and the second protrusion 205*g* protrude outward from the placing surface 205*a* in the width direction A2. The first protrusion 205*f* and the second protrusion 205*g* have an oval shape, in particular, a circular shape.

The bond portion 205*h* is provided so as to bond the first protrusion 205*f* and the second protrusion 205*g* to each other. The bond portion 205*h* protrudes outward from the placing surface 205*a*, and is formed so as to be flush with the first protrusion 205*f* and the second protrusion 205*g*, in the width direction A2. On the other hand, the bond portion 205*h* does not protrude upward from the placing surface 205*a* of the first ejection tray 205, and does not protrude downward from the lower surface of the first ejection tray 205, in the height direction A3. That is, the first protrusion 205*f* and the second protrusion 205*g* protrude upward and/or downward from the bond portion 205*h* in the height direction A3, respectively.

Figure 9:
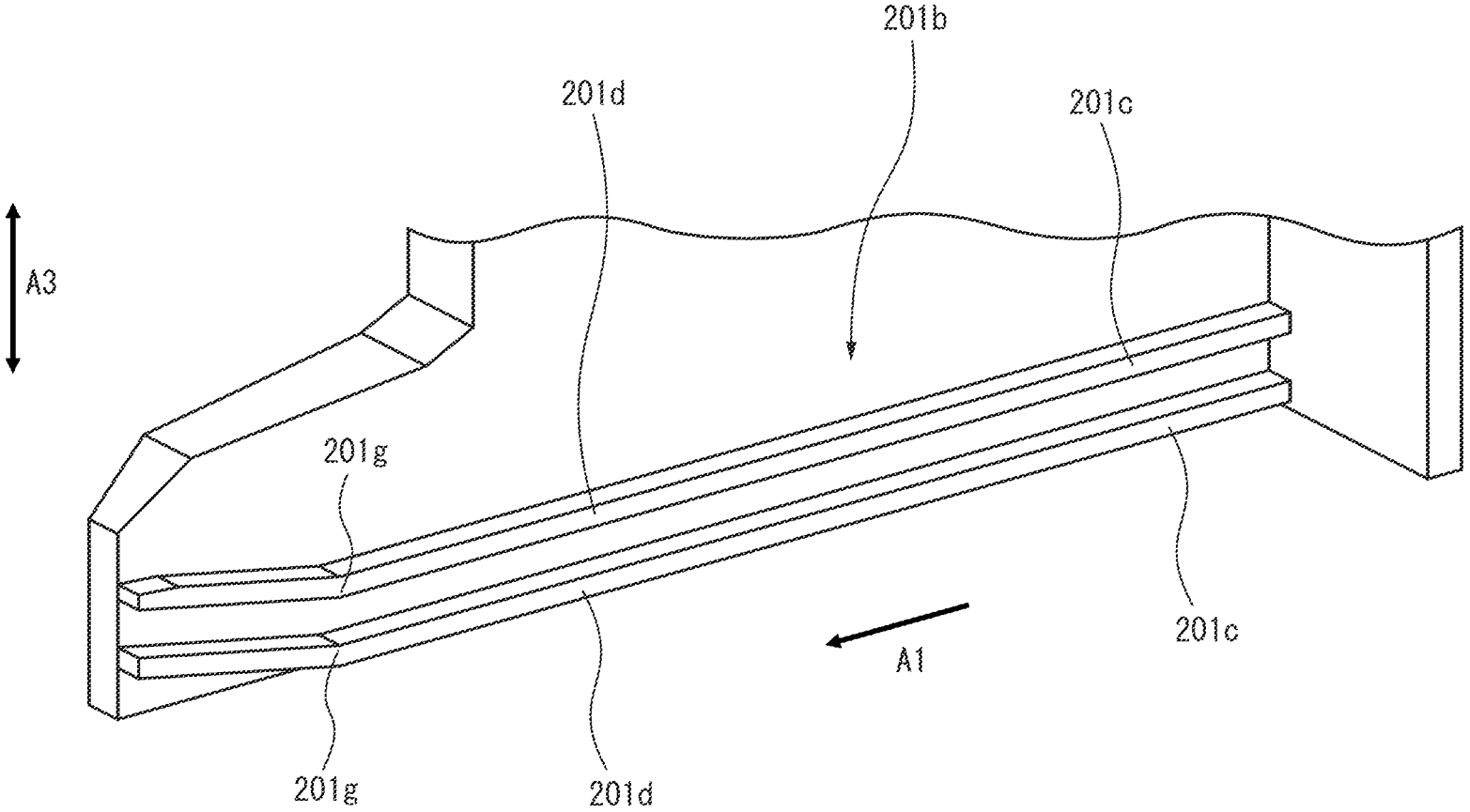
FIG. 9 is a schematic diagram for illustrating another accommodation portion 201*b*.

FIG. 9 is a schematic diagram for illustrating an accommodation portion 201*b* of the medium conveying apparatus according to the present embodiment. FIG. 9 illustrates the accommodation portion 201*b* in a state where the first ejection tray 205 is removed.

The accommodation portion 201*b* is used in place of the accommodation portion 101*b* of the medium conveying apparatus 100. As illustrated in FIG. 9, similarly to the accommodation portion 101*b* of the medium conveying apparatus 100, the accommodation portion 201*b* is provided with a guide unit 201*c* at an end portion in the width direction A2 perpendicular to the medium ejecting direction. The guide portion 201*c* is located so as to face the engaging portion 205*e* provided on the side surface 205*c* of the first ejection tray 205. The guide portion 201*c* includes a pair of first rails 201*d*.

The pair of first rails 201*d* is an example of a pair of rails, and is provided from the upstream end portion to the downstream end portion of the guide portion 201*c* in the medium ejecting direction A1. The pair of first rails 201*d* includes a bent portion 201*g* that bends upward. The pair of first rails 201*d* extend substantially in parallel to an installation surface of the medium conveying apparatus on the upstream side of the bending portion 201*g*, and are inclined upward so that the downstream end portion is positioned upward on the downstream side of the bending portion 201*g*. The pair of first rails 201*d* has a predetermined width from the upstream end portion to the downstream end portion of the guide portion 201*c* in the medium ejecting direction A1. The predetermined width is substantially the same size as the size of the first protrusion 205*f* and the second protrusion 205*g* provided on the first ejection tray 205 in the height direction A3. Thus, the engaging portion 205*e* engages with the pair of first rails 201*d* of the guide portion 201*c* and is provided so as to slide between the pair of first rails 201*d*.

FIGS. 10A, 10B, 11A, 11B, 12A, 12B, 13A and 13B are schematic diagrams for illustrating an operation of the first ejection tray 205. FIGS. 10A, 10B, 11A, 11B, 12A, 12B, 13A and 13B are cross-sectional views of the accommodation portion 201*b* cut in a cross section parallel to the medium ejecting direction A1 and the height direction A3. FIGS. 10A, 11A, 12A and 13A are cross-sectional views of the accommodation portion 201*b*, as viewed from above. FIGS. 10B, 11B, 12B and 13B are a cross-sectional views of the accommodation portion 201*b*, as viewed from below.

Figure 10A:
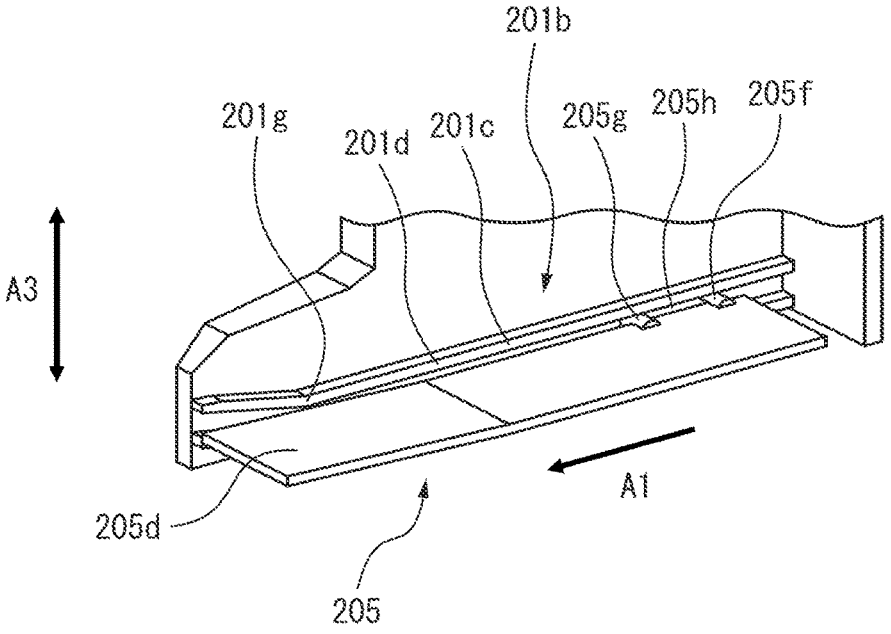
FIG. 10A is a schematic diagram for illustrating an operation of the first ejection tray 205.
Figure 10B:
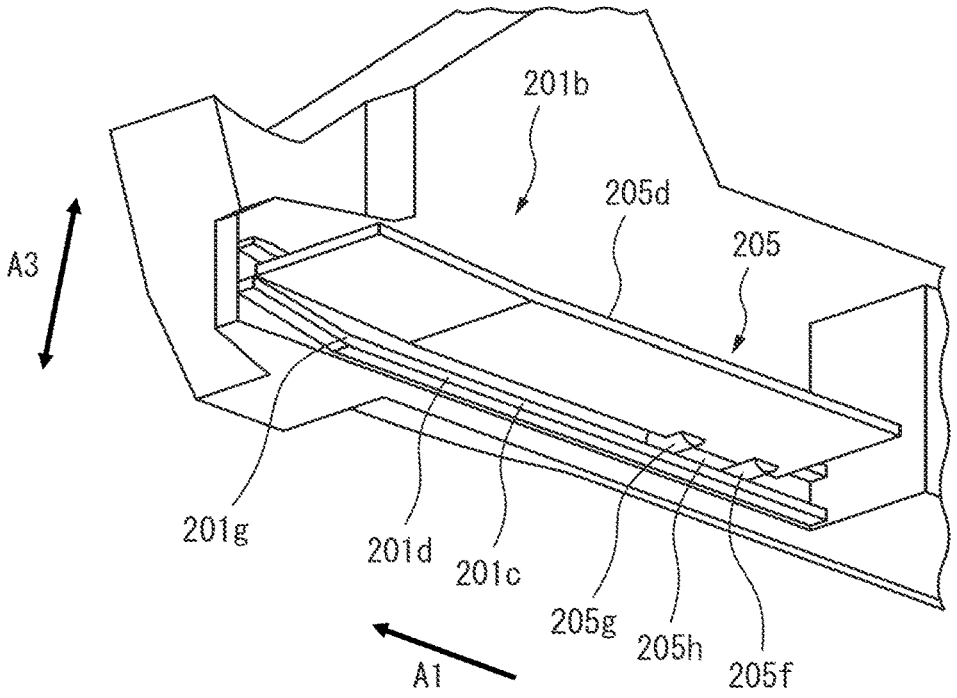
FIG. 10B is a schematic diagram for illustrating the operation of the first ejection tray 205.

FIGS. 10A and 10B are cross-sectional views of the accommodation portion 201*b* in which the first ejection tray 205 is accommodated. As illustrated in FIGS. 10A and 10B, when the first ejection tray 205 is accommodated in the accommodating portion 201*b*, the first protrusion 205*f* and the second protrusion 205*g* of the engaging portion 205*e* are located between the pair of first rails 201*d*, and clamped by the pair of first rails 201*d*.

Figure 11A:
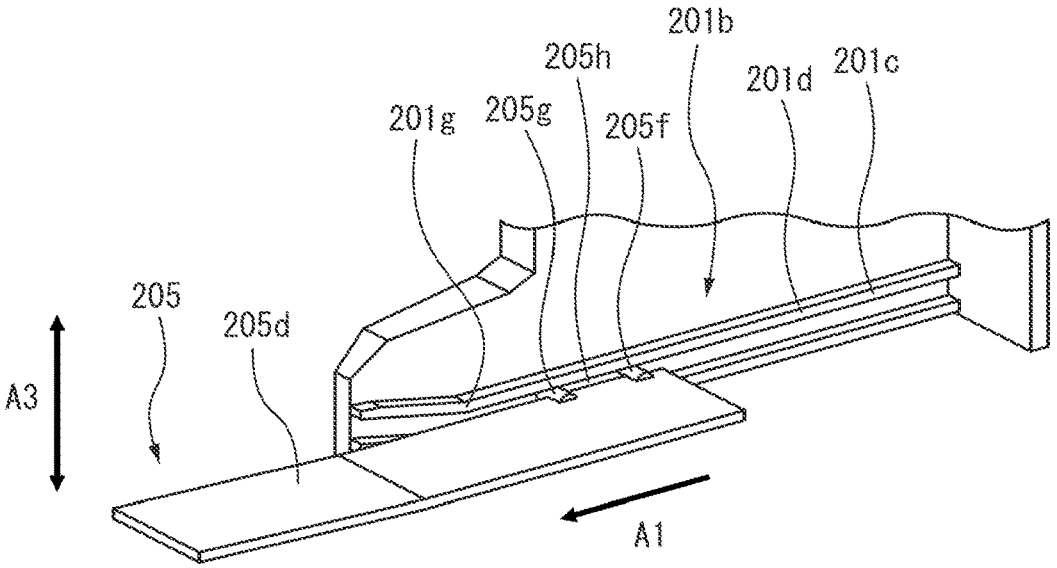
FIG. 11A is a schematic diagram for illustrating the operation of the first ejection tray 205.
Figure 11B:
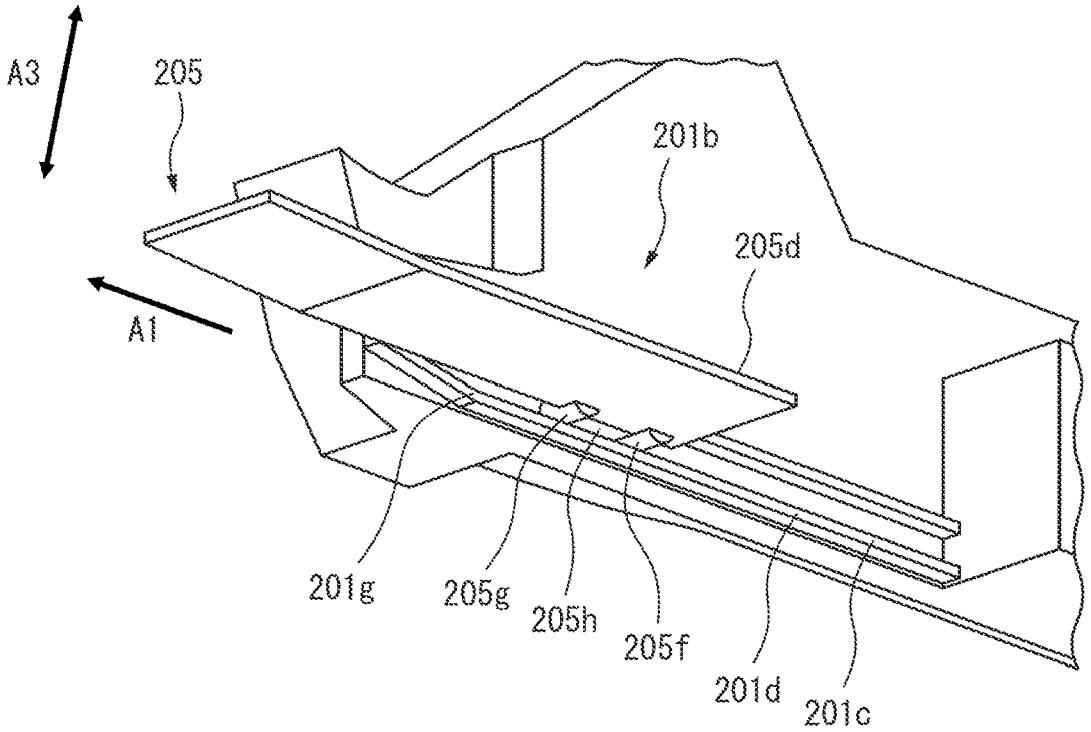
FIG. 11B is a schematic diagram for illustrating the operation of the first ejection tray 205.

FIGS. 11A and 11B are cross-sectional views of the accommodation portion 201*b* in which the first ejection tray 205 is slightly pulled out. As illustrated in FIGS. 11A and 11B, the second protrusion 205*g* and the first protrusion 205*f* slide along a portion extending approximately parallel to an installation surface of the medium conveying apparatus, in the first rails 201*d* until they pass through the bending portion 201*g*. Thus, the first ejection tray 205 slides in substantially parallel to the installation surface of the medium conveying apparatus.

Figure 12A:
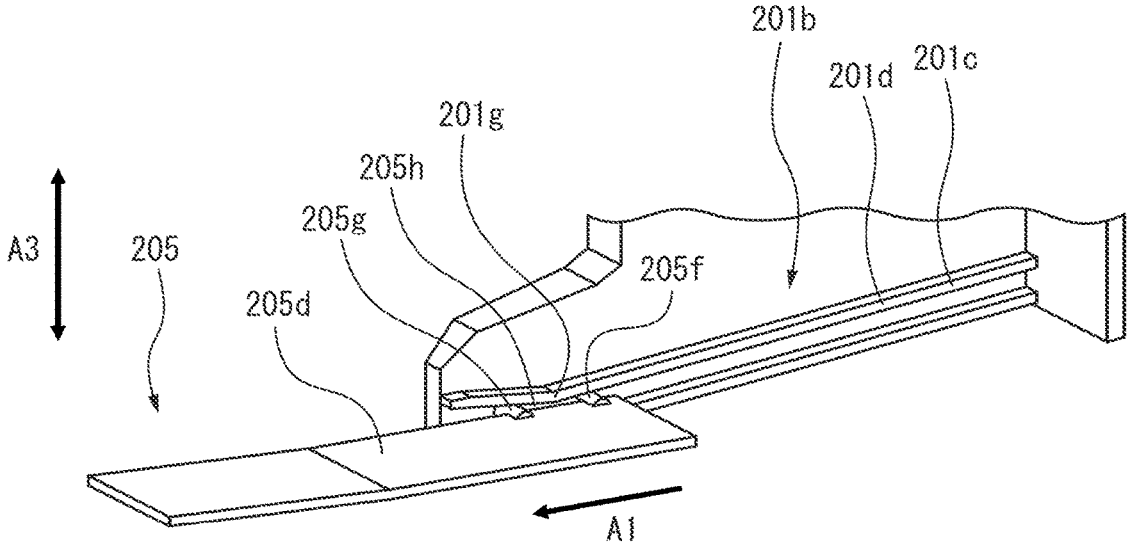
FIG. 12A is a schematic diagram for illustrating the operation of the first ejection tray 205.
Figure 12B:
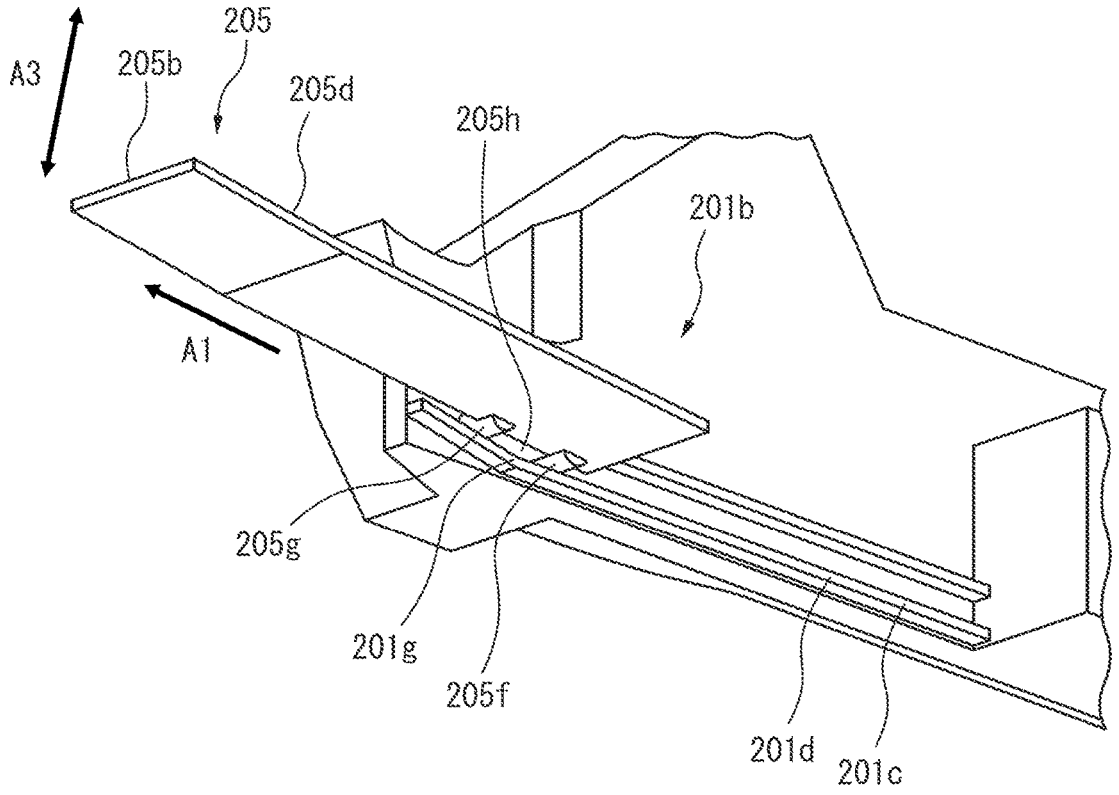
FIG. 12B is a schematic diagram for illustrating the operation of the first ejection tray 205.

FIGS. 12A and 12B are cross-sectional views of the accommodation portion 201*b* in which the first ejection tray 205 is further pulled out from the state showed in FIGS. 11A and 11B. FIGS. 12A and 12B illustrate a state where the second protrusion 205*g* located on the upstream side passes through the bending portion 201*g*, and the first protrusion 205*f* located on the downstream side does not pass through the bending portion 201*g* yet. In the state shown in FIGS. 12A and 12B, the first protrusion 205*f* slides along a portion extending substantially parallel to the installation surface of the medium conveying apparatus, in the first rail 201*d*, and the second protrusion 205*g* slides along a portion inclined upward in the first rail 201*d*. Thus, the first ejection tray 205 is inclined such that the front end portion 205*b* of the downstream side in the medium ejecting direction A1 is positioned upward.

Similar to the first protrusion 105*f* and the second protrusion 105*g* of the medium conveying apparatus 100, the first protrusion 205*f* and the second protrusion 205*g* sliding along the guide portion 201*c* are located apart from each other, so that a recess is provided between the first protrusion 205*f* and the second protrusion 205*g*. Therefore, the engaging portion 205*e* of the first ejection tray 205 does not contact the bent portion 201*g* of the first rail 201*d*, and the first ejection tray 205 can satisfactorily change the orientation. In particular, since the engaging portion 205*e* is provided with the recess with respect to upper ends of the first protrusion 205*f* and the second protrusion 205*g*, the first ejection tray 205 can change the orientation upward in the bending portion 201*g* that bends upward.

Figure 13A:
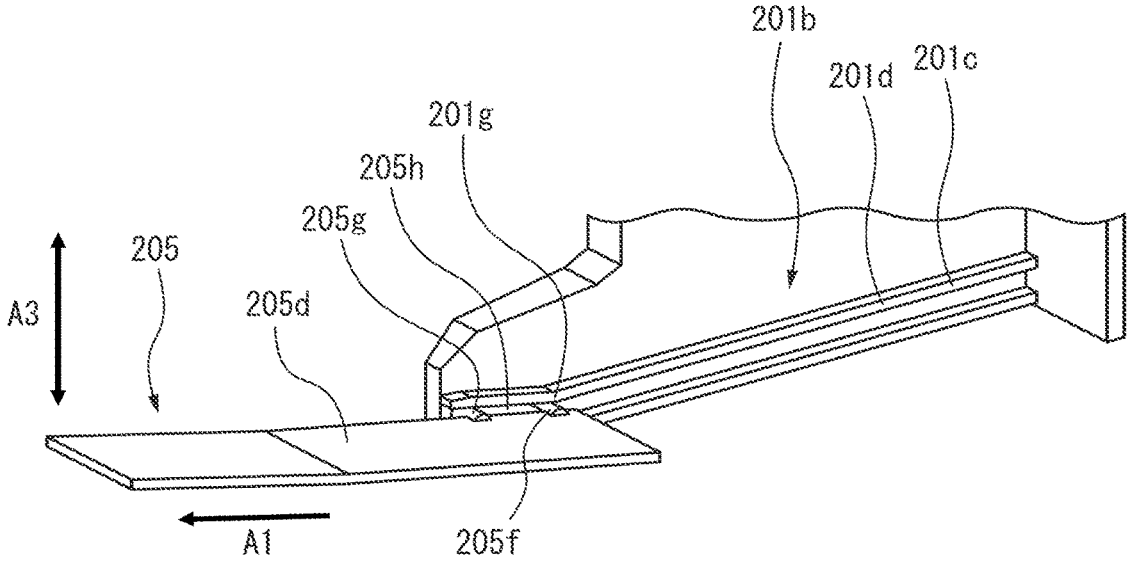
FIG. 13A is a schematic diagram for illustrating the operation of the first ejection tray 205.
Figure 13B:
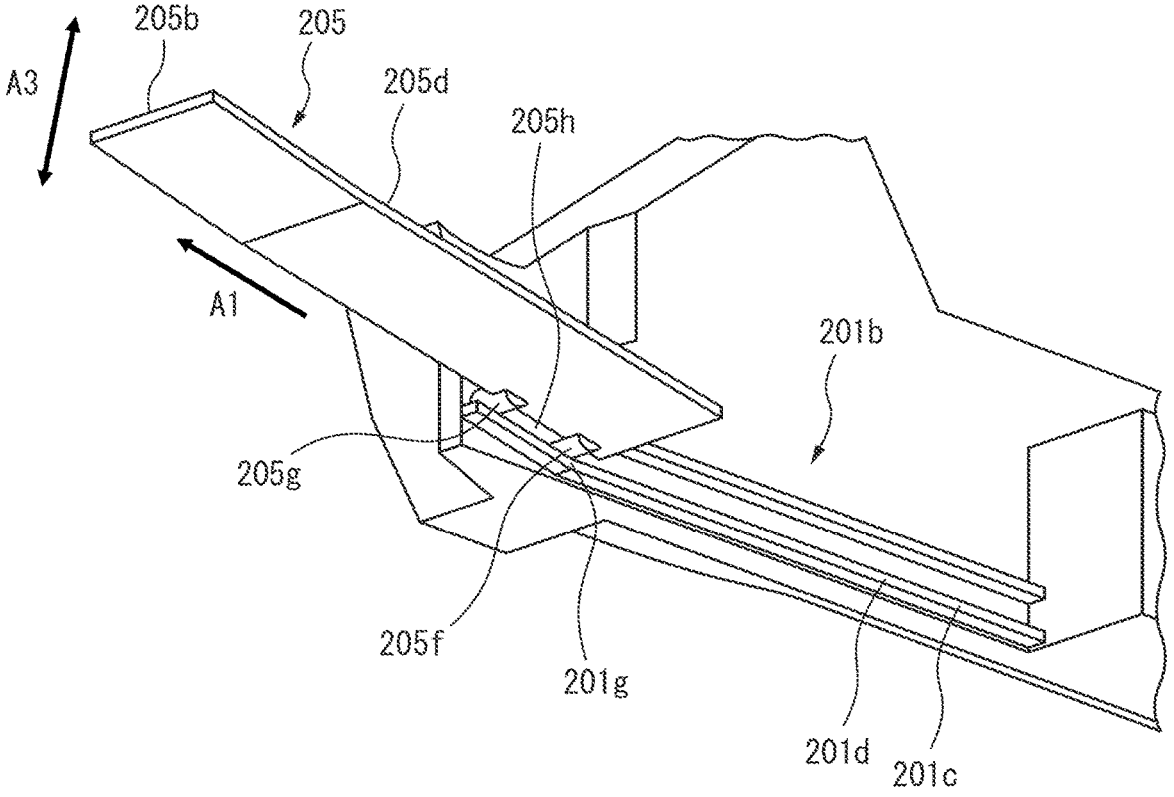
FIG. 13B is a schematic diagram for illustrating the operation of the first ejection tray 205.

FIGS. 13A and 13B are cross-sectional views of the accommodation portion 201*b* in which the first ejection tray 205 is fully pulled out. As illustrated in FIGS. 13A and 13B, when the first ejection tray 205 is fully pulled out from the accommodation portion 201*b*, the second protrusion 205*g* and the first protrusion 205*f* are located at the inclined part in the pair of first rails 201*d*, and clamped by the pair of first rails 201*d*. Thus, the first ejection tray 205 is positioned at a predetermined set position with respect to the lower housing 101 with the front end portion 205*b* of the downstream side in the medium ejecting direction A1 located upward.

As described above, the first protrusion 205*f* and the second protrusion 205*g* have a circular shape. Thus, the first protrusion 205*f* and the second protrusion 205*g* can change the orientation smoothly, when the first ejection tray 205 is pulled out from the accommodation portion 201*b*, even when the first protrusion 205*f* or the second protrusion 205*g* come into contact with the bent position in the guide portion 201*c*.

Further, the medium conveying apparatus can increase the strength of the first protrusion 205*f* and the second protrusion 205*g*, by the bond portion 205*h* provided between the first protrusion 205*f* and the second protrusion 205*g*. Thus, the first protrusion 205*f* and the second protrusion 205*g* are stably clamped by the pair of first rails 201*d*, and the occurrence of the breakage of the engaging portion 205*e* is suppressed.

The engaging portion 205*e* may include at least the first protrusion 205*f* and the second protrusion 205*g*, and the bond portion 205*h* may be omitted.

Figure 14:
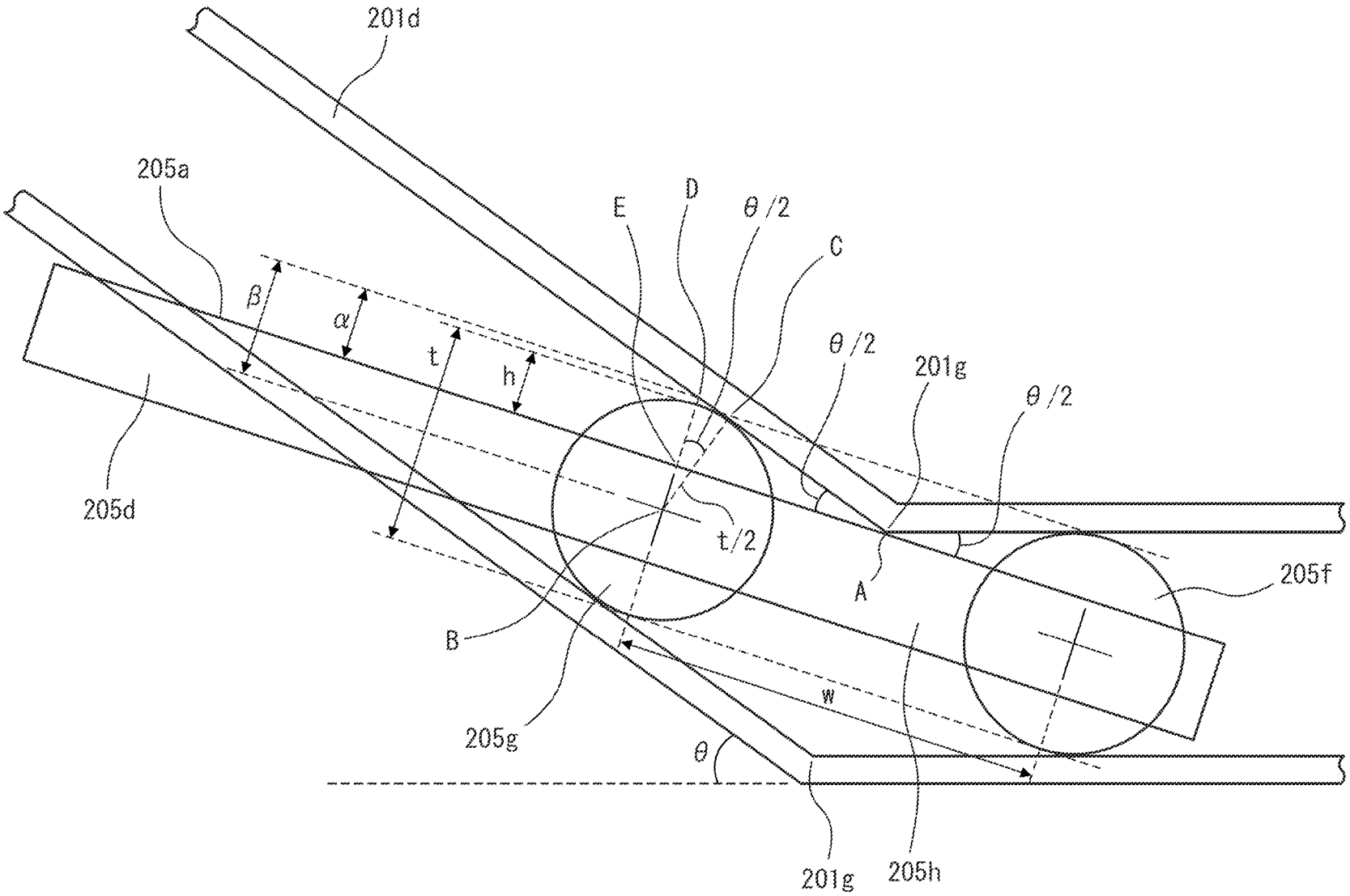
FIG. 14 is a schematic diagram for illustrating a size of a first protrusion 205*f*, etc.

FIG. 14 is a schematic diagram for illustrating sizes of the first protrusion 205*f* and the second protrusion 205*g*. FIG. 14 is a schematic view of the first ejection tray 205 and the first rail 201*d*, as viewed from the side. In an example illustrated in FIG. 14, it is assumed that an upper surface of the bond portion 205*h* is flush with the placing surface 205*a* of the placing portion 205*d*. FIG. 14 illustrates a state where a center position between the first protrusion 205*f* and the second protrusion 205*g* in an extending direction of the first ejection tray 205 on the upper surface of the bond portion 205*h* contact the apex of the upper bending portion 201*g*. That is, in FIG. 14, when the first ejection tray 205 is viewed from the side, the center position A between the first protrusion 205*f* and the second protrusion 205*g* in the extending direction of the first ejection tray 205 on the placing surface 205*a* is located at the same position as the apex of the upper bending portion 201*g*.

As illustrated in FIG. 14, when the center position A on the placing surface 205*a* is located at the same position as the apex of the upper bent portion 201*g*, angles formed by the placing surface 205*a* and the lower surface of the upper first rail 201*d* are equal on the upstream side and the downstream side of the center position A, respectively. Therefore, when an angle at which the pair of first rails 201*d* bends is θ, an angle formed by the placing surface 205*a* and the lower surface of the upper first rail 201*d* on the upstream side and the downstream side of the center position A is (θ/2).

The following equation (1) is established for a triangle whose apexes are a center B of the second protrusion 205*g*, a contact point C between the second protrusion 205*g* and the upper first rail 201*d*, and an intersection point D at which a straight line extending from the center B in the height direction of the first ejection tray 205 and the upper first rail 201*d* intersect.

$$\cos(\theta/2) = (t/2)/\beta \tag{1}$$

Wherein, θ is an angle at which the pair of first rails 201*d* is bent. t is a height (diameter) of the first protrusion 205*f* and the second protrusion 205*g* in the height direction of the first ejection tray 205. β is a distance between the center B of the second protrusion 205*g* and the intersection point D at which the straight line extending from the center B in the height direction of the first ejection tray 205 and the upper first rail 201*d* intersect in the height direction of the first ejection tray 205.

The following equation (2) is established for a triangle whose apexes are the center position A, the intersection D, and an intersection E at which the straight line extending from the center B of the second protrusion 205*g* in the height direction of the first ejection tray 205 and the placing surface 205*a* intersect.

$$\tan(\theta/2) = \alpha/(w/2) \tag{2}$$

Wherein, α is a distance between the placing surface 205*a* and the intersection point D in the height direction of the first ejection tray 205. w is a distance between the center position between the first protrusion 205*f* and the second protrusion 205*g* in the extending direction of the first ejection tray 205.

Further, the following equation (3) is established for a size h in which the first protrusion 205*f* and the second protrusion 205*g* protrude from the placing surface 205*a* so that the placing surface 205*a* provided so as to be flush with the upper surface of the bond portion 205*h* is not located above the apex of the upper bending portion 201*g*.

$$h \geqq \alpha - \{\beta - (t/2)\} \quad (3)$$

In order for the engaging portion 205*e* to satisfactorily support the first ejection tray 205, the center position between the first protrusion 205*f* and the second protrusion 205*g* is preferably located at the same position as the center position of the placing portion 205*d* in the height direction of the first ejection tray 205. In this case, the following equation (4) is established since the size h in which the first protrusion 205*f* and the second protrusion 205*g* protrude from the placing surface 205*a* is not equal to or larger than ½ of the height t of the first protrusion 205*f* and the second protrusion 205*g*.

$$h < (t/2) \quad (4)$$

From the above equations (1) to (4), the size h in which the first protrusion 205*f* and the second protrusion 205*g* protrude from the placing surface 205*a* is determined such that the following equation (5) is established.

$$(t/2) + (w/2) \times \tan(\theta/2) - (t/2)/\cos(\theta/2) \leqq h < (t/2) \quad (5)$$

As described above, the distance w is determined based on the material (hardness) or the weight of the first ejection tray 205, and/or the arrangement positions of the first protrusion 205*f* and the second protrusion 205*g*. The distance w is preferably, for example, 8 mm or more and 20 mm or less, such that the engaging portion 205*e* satisfactorily supports the first ejection tray 205. For example, when the angle θ is 5°, the height t is 5.3 mm, and the distance w is 12 mm, the size h is set to 0.3 mm or more and less than 2.7 mm.

It is prevented that the bond portion 205*h* collides with the bent portion 201*g* and the first ejection tray 205 is not pulled out, by the first protrusion 205*f* and the second protrusion 205*g* provided such that the above equation (5) is established.

As described in detail above, in the medium conveying apparatus, the first ejection tray 205 can be pulled out satisfactorily from the accommodation portion 201*b* even when the accommodation portion 201*b* and the first ejection tray 205 are used.

According to embodiment, in the medium conveying apparatus, the tray can be pulled out satisfactorily from the accommodation portion of the housing.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiment(s) of the present inventions have been described in detail, it should be understood that the various changes, substitutions, and alterations could be made hereto without departing from the spirit and scope of the invention.

What is claimed is:

1. A medium conveying apparatus comprising:

a housing including an accommodation portion provided with a guide portion at an end portion in a width direction perpendicular to a medium ejecting direction;

a tray accommodated in the accommodation portion to be pulled out, and including a placing surface for placing an ejected medium; and an engaging portion provided on a side surface of the tray, to engage the guide portion, wherein the guide portion includes a pair of rails inclined upward and having a predetermined width, wherein the engaging portion includes two protrusions provided to slide between the pair of rails and located apart from each other by a predetermined distance, and a bond portion, located between the pair of rails in the width direction, to bond the two protrusions, wherein by locating the two protrusions between the pair of rails, the tray is positioned at a predetermined position with respect to the housing with a front end portion of a downstream side in the medium ejecting direction located upward, and wherein the two protrusions protrude upward and downward from the bond portion such that the bond portion does not come into contact with the pair of rails when the tray is pulled out.

2. The medium conveying apparatus according to claim 1, wherein the protrusions have a circular or oval shape.

3. The medium conveying apparatus according to claim 1, wherein the guide portion is bent upward, and wherein the protrusions protrude upward from the placing surface.

4. The medium conveying apparatus according to claim 1, wherein the pair of rails includes a bent portion that bends upward, and wherein the protrusions protrude upward from the placing surface.

5. The medium conveying apparatus according to claim 4, wherein the protrusions have a circular shape, and wherein a size h in which the protrusions protrude from the placing surface is defined such that a following equation is established, $$(t/2) + (w/2) \times \tan(\theta/2) - (t/2)/\cos(\theta/2) \leqq h < (t/2)$$

wherein, t is a height of the two protrusions, w is a distance between center positions of the two protrusions, θ is an angle at which the pair of rails is bent.

6. The medium conveying apparatus according to claim 1, wherein the bond portion protrudes outward from side surface of the tray is flushed with the two protrusions.

* * * * *